US007466936B2

(12) United States Patent
Tokuzaki

(10) Patent No.: US 7,466,936 B2
(45) Date of Patent: Dec. 16, 2008

(54) LASER PRINTER APPARATUS

(75) Inventor: Masaaki Tokuzaki, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 138 days.

(21) Appl. No.: 11/352,653

(22) Filed: Feb. 13, 2006

(65) Prior Publication Data

US 2006/0209164 A1 Sep. 21, 2006

(30) Foreign Application Priority Data

Mar. 18, 2005 (JP) ..... 2005-079529

(51) Int. Cl.
*G03G 21/20* (2006.01)

(52) U.S. Cl. ..... 399/92

(58) Field of Classification Search ..... 399/92, 399/93, 107–126
See application file for complete search history.

(56) References Cited

U.S. PATENT DOCUMENTS 6,266,498 B1 * 7/2001 Oda et al. ..... 399/92
2006/0093391 A1 * 5/2006 Uchida et al. ..... 399/92

FOREIGN PATENT DOCUMENTS

JP 08324068 A * 12/1996
JP 2001318577 A * 11/2001
JP 2001-337290 12/2001
JP 2004-012859 1/2004
JP 2004-2621176 9/2004

OTHER PUBLICATIONS

Patent Abstracts of Japan, Application No. 2004-012859, dated Jan. 15, 2004 (1 page).
Patent Abstracts of Japan, Application No. 2004-262117, dated Sep. 24, 2004 (1 page).
Patent Abstracts of Japan, Application No. 2001-337290, dated Dec. 7, 2001 (1 page).

* cited by examiner

*Primary Examiner*—Ryan Gleitz
(74) *Attorney, Agent, or Firm*—Osha Liang LLP

(57) ABSTRACT

In a laser printer apparatus, a top cover is arranged to cover a base member, a fixing unit, and a laser scanning unit. At a raised portion formed for reinforcement at an end portion of the base member on the side of fixing unit, a plurality of openings are formed along one direction, with the area of the openings made gradually larger as the distance from a fan increases. On the top cover, a wall portion is formed integrally, protruding to the side of the base member, and by the wall portion and the raised portion, an air passage is formed. Thus, a laser printer is provided in which the fixing unit and the laser scanning unit can be cooled, without necessitating any additional member.

5 Claims, 6 Drawing Sheets

LASER PRINTER APPARATUS

BACKGROUND OF THE INVENTION

1. Field of the Invention

The present invention relates to a laser printer apparatus and, more specifically, to a laser printer apparatus including a cooling fan.

2. Description of the Background Art

A laser printer apparatus is one type of printer apparatuses. As can be seen from FIG. 7, in a laser printer apparatus 101, a prescribed sheet of paper 120 fed from a paper feed inlet 113 of laser printer apparatus 101 passes through a photoreceptor 102, while the photoreceptor 102 is irradiated with a prescribed laser beam in accordance with an image signal, by a laser scanning unit 104. Consequently, toner is transferred to the sheet of paper 120. The sheet of paper 120 on which the toner has been transferred has its toner fixed in a fixing unit 105, and then the sheet is discharged from a discharge outlet 114. The toner is supplied from a cartridge 103.

In the series of printing operations, the fixing process is performed at a temperature of about 200° C., and therefore, fixing unit 105 radiates heat. Further, photoreceptor 102 is irradiated with the laser beam based on an image signal, by rotating a prescribed polygon mirror provided in laser scanning unit 104, and therefore, in laser scanning unit 104, a polygon motor (not shown) for rotating the polygon mirror is provided. Laser scanning unit 104 is heated by the rotation of the polygon motor.

In order to prevent heat generated in fixing unit 105 and generated in laser scanning unit 104 from building up in laser printer apparatus 101, a cooling fan (not shown) is provided in laser printer apparatus 101. Methods of removing heat generated in printer apparatuses and the like are disclosed in Japanese Patent Laying-Open Nos. 2004-012859, 2004-262117 and 2001-337290.

SUMMARY OF THE INVENTION

The conventional laser printer apparatus 101, however, suffers from the following problem. When a cooling fan is to be provided in laser printer apparatus 101, it is a common practice to provide the cooling fan on a side of laser printer apparatus 101 in order not to hinder feeding of a sheet of paper 120 and to reduce the size of the apparatus. In that case, an additional duct (not shown) is often provided inside the laser printer apparatus 101 in order to take the heat from fixing unit 105 and laser scanning unit 104. This is one factor that hinders further size reduction of laser printer apparatus 101. Further, use of an additional member hinders reduction in production cost.

The present invention was made to solve the above-described problem, and its object is to provide a laser printer apparatus that can cool the fixing unit and the laser scanning unit without using any additional member.

The laser printer apparatus in accordance with the present invention includes: a pair of frames; a base member; a laser scanning unit; a fixing unit; a fan; a top cover; a raised portion; a plurality of openings; and a prescribed wall portion. The pair of frames is arranged opposite to each other. The base member is fixed on each of the pair of frames and extends in one direction across the pair of frames. The laser scanning unit is placed on the base member and directs a laser beam in accordance with a prescribed image signal. The fixing unit is arranged aligned to a side in a direction approximately orthogonal to one direction of the base member, and fixes the toner transferred to the sheet of paper. The fan is arranged on one of the pair of frames at a position corresponding to an end along one direction of the base member. The top cover is arranged to cover the base member, the laser scanning unit, the fixing unit and the fan. The raised portion is provided on an end portion of base member positioned on the side of the fixing unit, raised toward the top cover and extends in one direction. The plurality of opening portions are formed in the raised portion along one direction, and each has a prescribed opening area. The prescribed wall portion is formed on the top cover to the side of base member, and together with the raised portion, serves as an air passage. The openings are formed such that opening areas become larger as the distance from the fan increases. The wall portion is arranged such that the polygon motor in the laser scanning unit is positioned between the raised portion and the wall portion.

By this structure, as the openings are formed at the raised portion of the base member and the wall portion is formed on the top cover, the air can be guided to the fixing unit and to the laser scanning unit without necessitating any additional member such as a duct, and therefore, the fixing unit and the laser scanning unit can reliably be cooled while the size can be made smaller.

According to another aspect, the laser printer apparatus of the present invention includes: a prescribed base member; a laser scanning unit; a fixing unit; a fan; and a raised portion. The prescribed base member extends in one direction. The laser scanning unit is placed on the base member and directs a laser beam in accordance with a prescribed image signal. The fixing unit is arranged aligned to a side in a direction approximately orthogonal to one direction of the base member, and fixes the toner transferred to the sheet of paper. The fan for cooling is arranged on a side of an end in one direction. The raised portion is formed on an end portion of the base member on the side where the fixing unit is arranged, and bent upward. The raised portion has an opening that communicates the side where the fixing unit is arranged with the side where the laser scanning unit is arranged.

By this structure, as the opening is provided at the raised portion of the base member, the air can be guided to the fixing unit and to the laser scanning unit without necessitating any additional member such as a duct, and therefore, the fixing unit and the laser scanning unit can reliably be cooled while the size can be made smaller.

Preferably, the opening includes a plurality of openings provided along one direction, and the plurality of openings have opening areas becoming larger as the distance from the fan increases.

Consequently, the difference in air flow passing through an opening far from the fan and the air flow passing through an opening closer to the fan becomes smaller, enabling uniform cooling of the laser scanning unit.

Preferably, the apparatus further includes a top cover arranged to cover the base member, the fixing unit and the laser scanning unit, and the top cover has a prescribed wall portion formed protruded to the side of the base member when the top cover is attached, for guiding air to the space formed with the raised portion.

Thus, an air passage is formed between the wall portion and the raised portion, so that the hot air does not stay in the laser printer apparatus but is reliably guided to the fan. Thus, the heat can be let off to the outside of the laser printer apparatus.

Preferably, the wall portion is arranged such that the polygon motor in the laser scanning unit is positioned between the raised portion and the wall portion.

Consequently, the polygon motor that generates heat can be cooled in a focused way.

Further, preferably, the fan is arranged positioned between the raised portion and the wall portion.

Consequently, the hot air can surely be led to the fan, and the heat can be let off to the outside of the laser printer apparatus.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
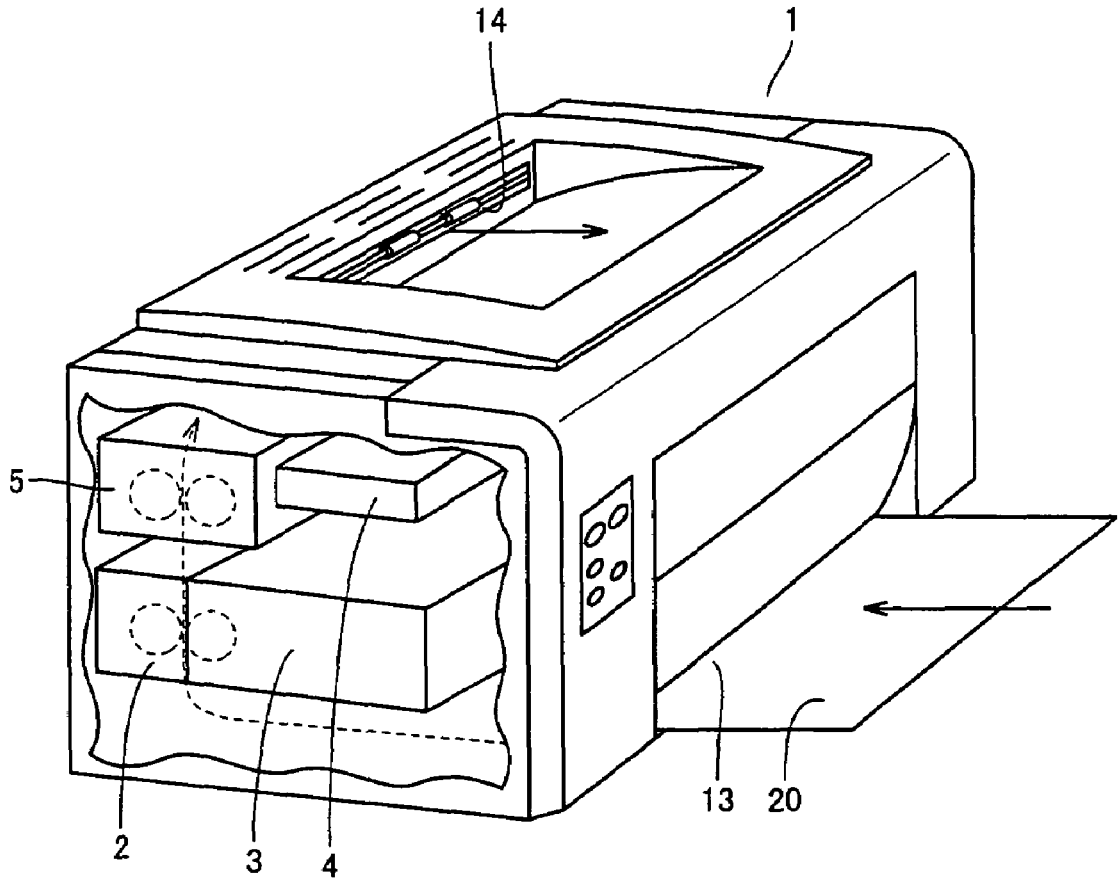
FIG. 1 is an exploded perspective view of the laser printer apparatus in accordance with an embodiment of the present invention.
Figure 2:
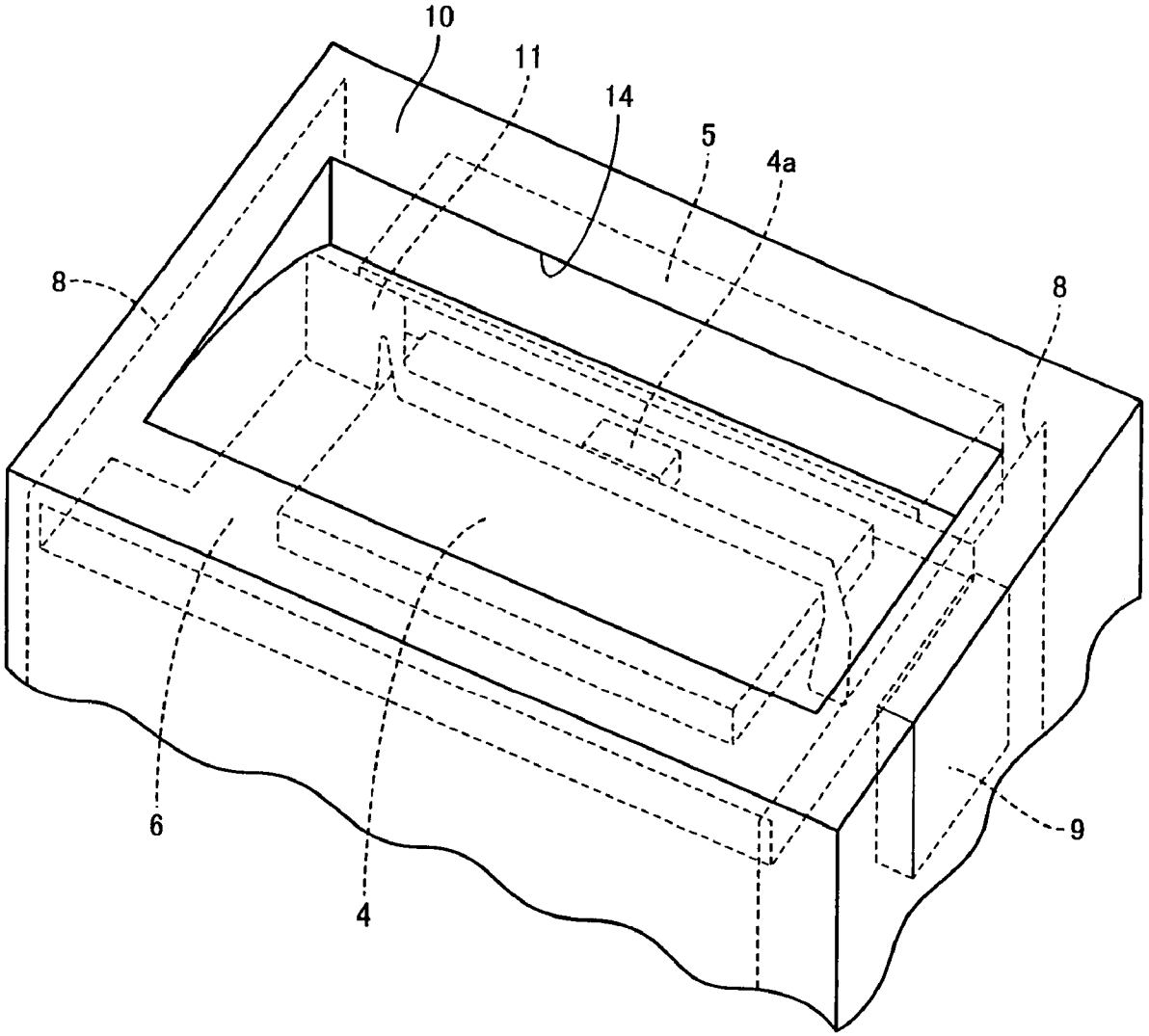
FIG. 2 is a partial perspective view showing an upper structure of the laser printer in accordance with the embodiment.

The laser printer apparatus in accordance with an embodiment of the present invention will be described in the following. As shown in FIGS. 1 and 2, in laser printer apparatus 1, a pair of frames 8 is arranged opposite to each other as a framework, and a prescribed base member 6 extending in one direction is fixed to and across the frames 8. Below the base member 6, a photoreceptor 2 that transfers toner to a prescribed sheet of paper 20 for printing an image is arranged, and a cartridge 3 supplying toner is arranged, opposite to photoreceptor 2.

Above the photoreceptor 2, a fixing unit 5 for fixing the toner transferred onto the sheet of paper 20 is arranged next to base member 6. On base member 6, a laser scanning unit 4 irradiating photoreceptor 2 with a laser beam based on a prescribed image signal is positioned. In laser scanning unit 4, a prescribed polygon mirror and a polygon motor 4*a* for rotating the polygon mirror (not shown) are provided, for irradiating the photoreceptor 2 with a laser beam based on the image signal. On one of the pair of frames 8, a fan 9 for cooling is arranged at a position corresponding to an end potion along one direction of base member 6.

Figure 3:
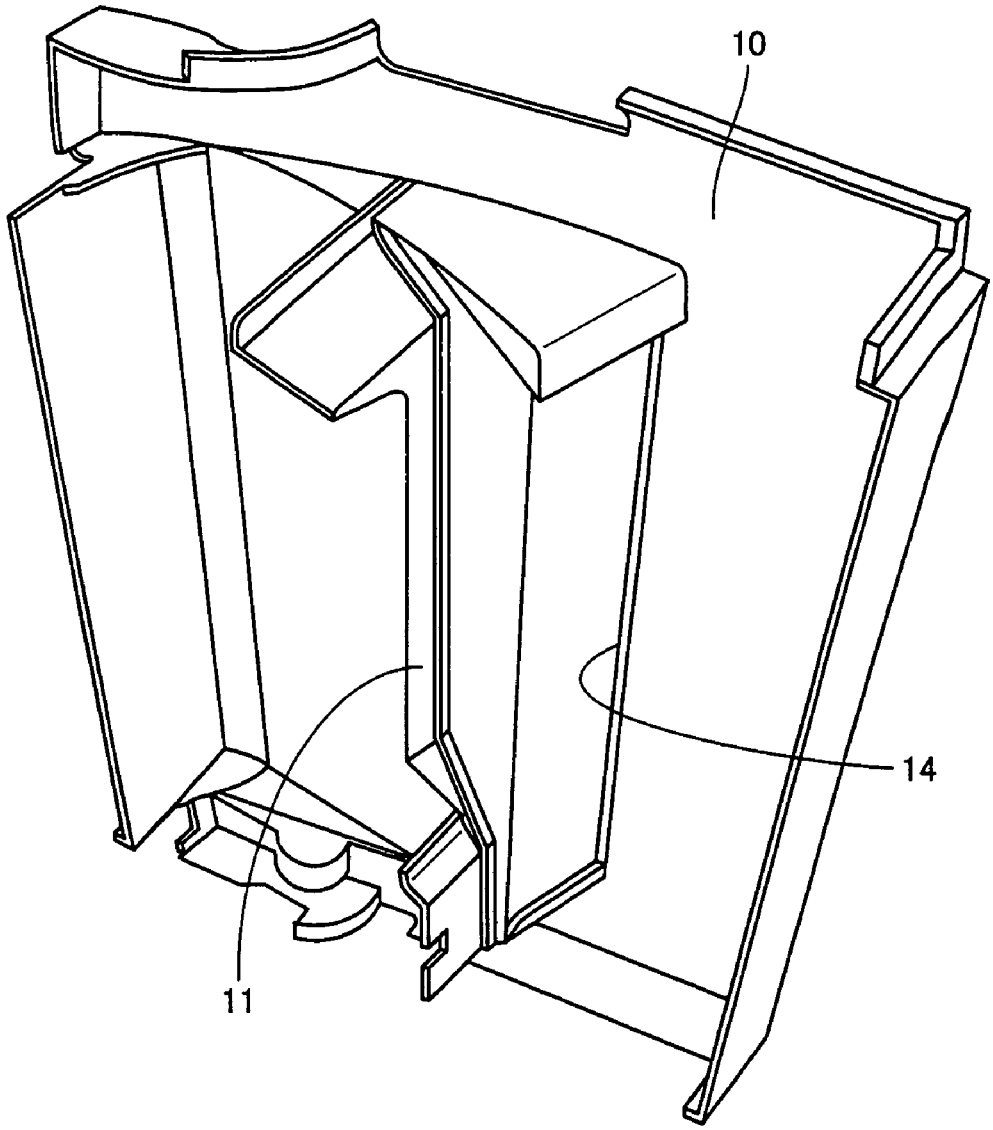
FIG. 3 is a perspective view of a top cover having a wall portion formed integrally, in accordance with the embodiment.

A top cover 10 is arranged to cover base member 6, fixing unit 5 and laser scanning unit 4. As shown in FIG. 3, a wall portion 11 is formed integrally with top cover 10, which wall portion protrudes to the side of base member 6 when top cover 20 is attached. Thus, an air passage is formed by wall portion 11 and a raised portion 7. As will be described later, wall portion 11 is arranged such that polygon motor 4*a* contained in laser scanning unit 4 is positioned between wall portion 11 and raised portion 7.

Figure 4:
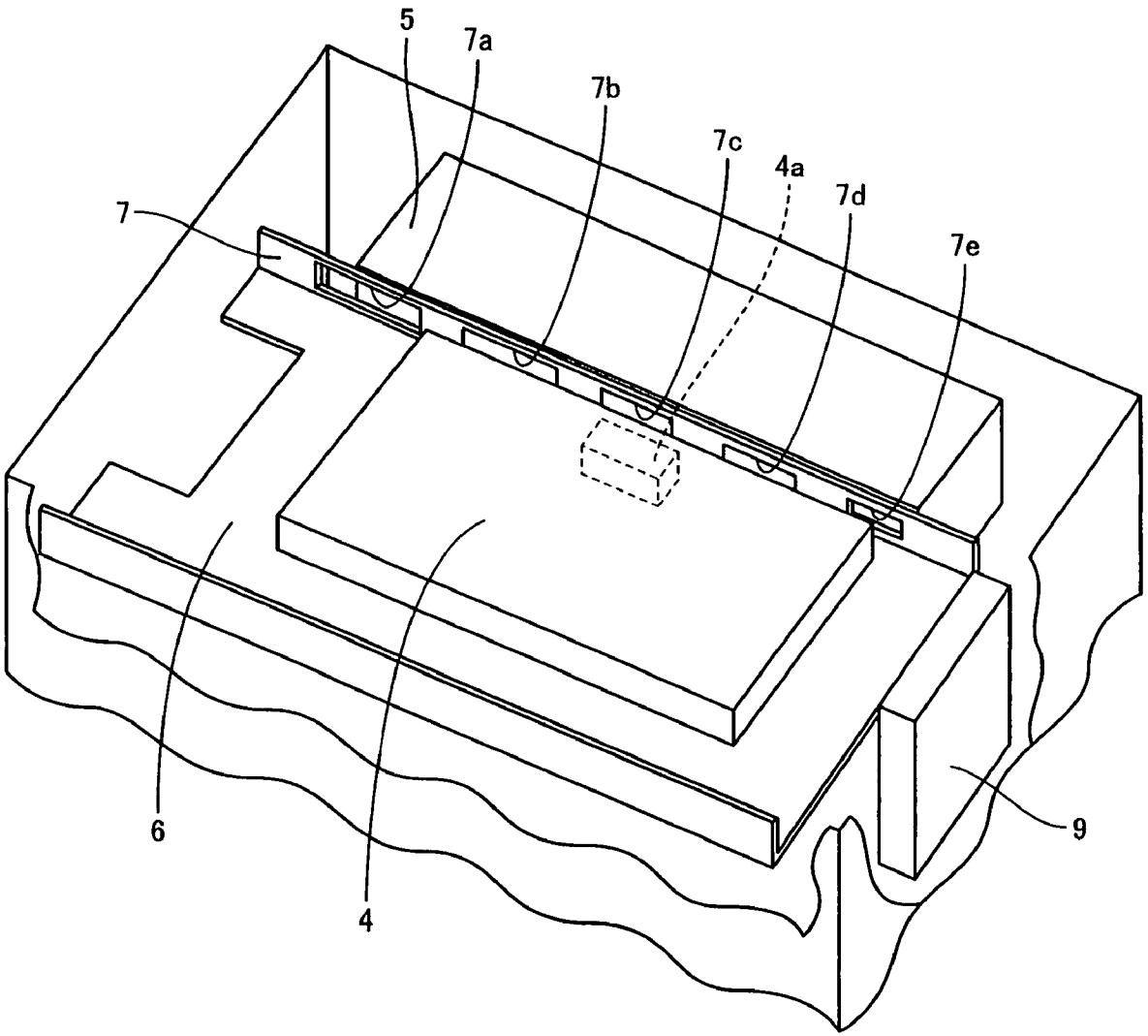
FIG. 4 is a partial perspective view showing a structure around the base member and the fixing unit, in the laser printer apparatus in accordance with the embodiment.
Figure 5:
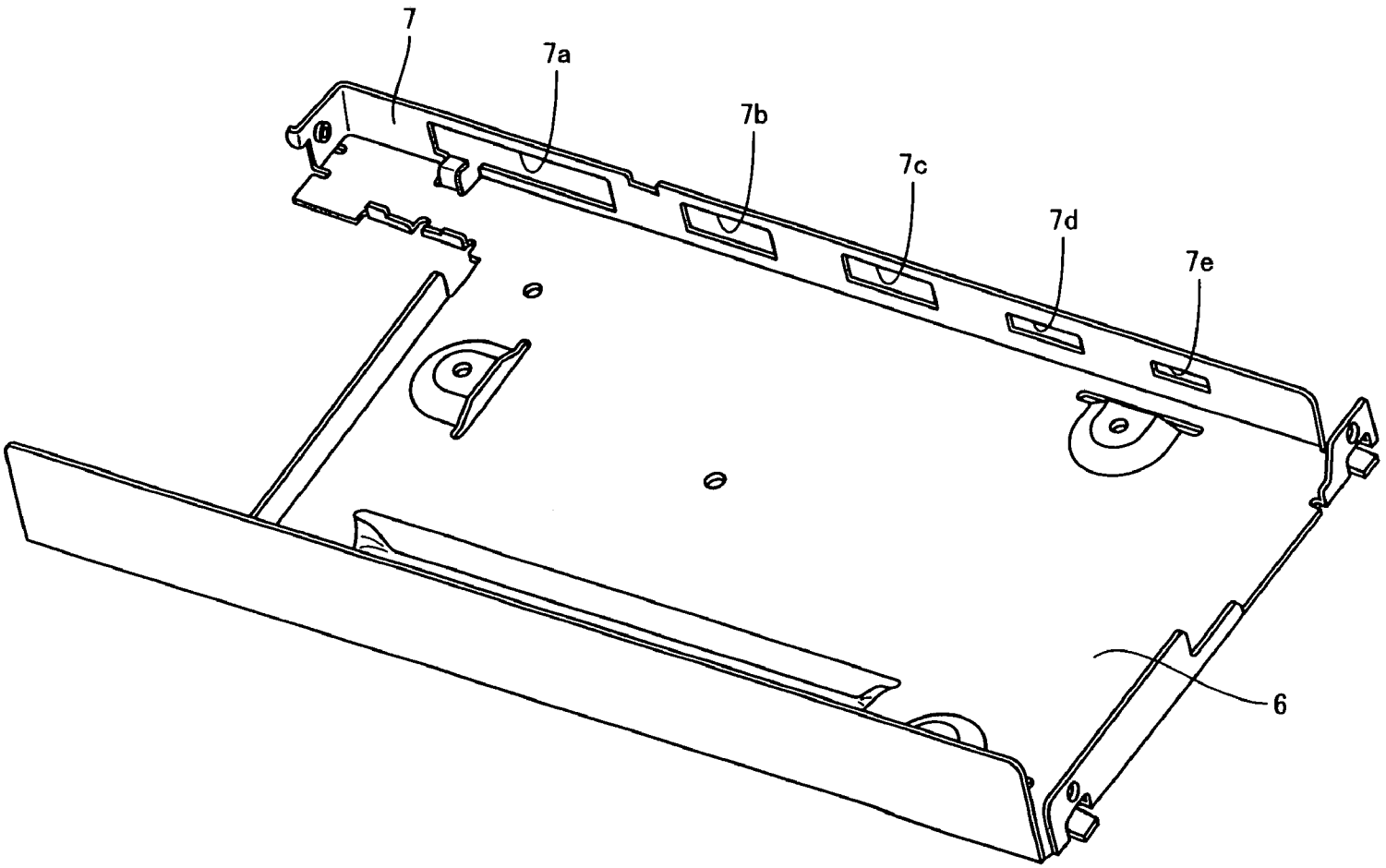
FIG. 5 is a perspective view of the base member in accordance with the embodiment.

As shown in FIGS. 4 and 5, on an end portion of base member 6 on the side of fixing unit 5, raised portion 7 is formed bent toward top cover 10 and extending in one direction, to ensure strength of base member 6. A plurality of openings 7*a* to 7*e* are formed along one direction in raised portion 7. The opening area of openings 7*a* to 7*e* is adapted such that the area becomes larger at an opening that is farther away from fan 9.

Next, an operation of laser printer apparatus 1 above will be described. As shown in FIG. 1, cartridge 3 containing toner is mounted on laser printer apparatus 1. A prescribed sheet of paper 20 fed (as represented by an arrow) from a paper feed inlet 13 of laser printer apparatus 1 is fed to photoreceptor 2. Photoreceptor 2 is irradiated with a prescribed laser beam derived from an image signal from laser scanning unit 4, and as the sheet of paper 20 passes over photoreceptor 2, the toner is transferred onto the sheet 20 in accordance with the laser beam irradiation. The sheet of paper 20, on which the toner has been transferred, is fed to fixing unit 5. At fixing unit 5, a process of fixing the toner on the sheet 20 at a prescribed temperature is performed. The sheet of paper 20 with the fixing process completed is discharged (as represented by an arrow) from discharge outlet 14. In this manner, the printing process by laser printer apparatus 1 is finished.

In the series of printing process, the fixing process at a temperature of about 200° C. is performed in fixing unit 5. Therefore, heat generates in fixing unit 5. In laser scanning unit 4, polygon motor 4*a* is driven to rotate a prescribed polygon mirror (not shown) contained therein, in accordance with the image signal. Consequently, heat also generates from laser scanning unit 4. The heat generated from fixing unit 5 and laser scanning unit 4 is exhausted to the outside of the laser printer apparatus by means of the fan 9.

In the laser printer apparatus described above, base member 6 is reinforced by providing a raised portion 7 by bending an end portion of base member 6, and openings 7*a* to 7*e* are provided in the raised portion, as shown in FIGS. 4 and 5. Further, fan 9 is arranged on a position of the frame corresponding to the end portion of base member 6 extending in one direction, and therefore, the air in laser printer apparatus 1 is discharged to the side of laser printer apparatus 1.

Figure 6:
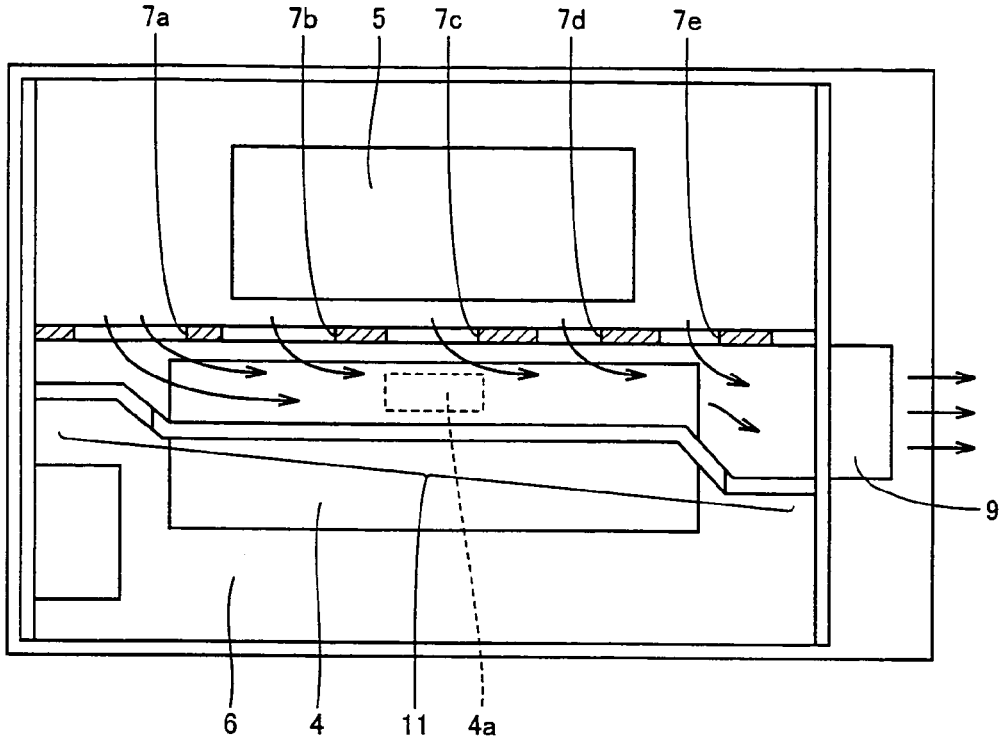
FIG. 6 is a plan view showing the air flow in the laser printer apparatus in accordance with the embodiment.
Figure 7:
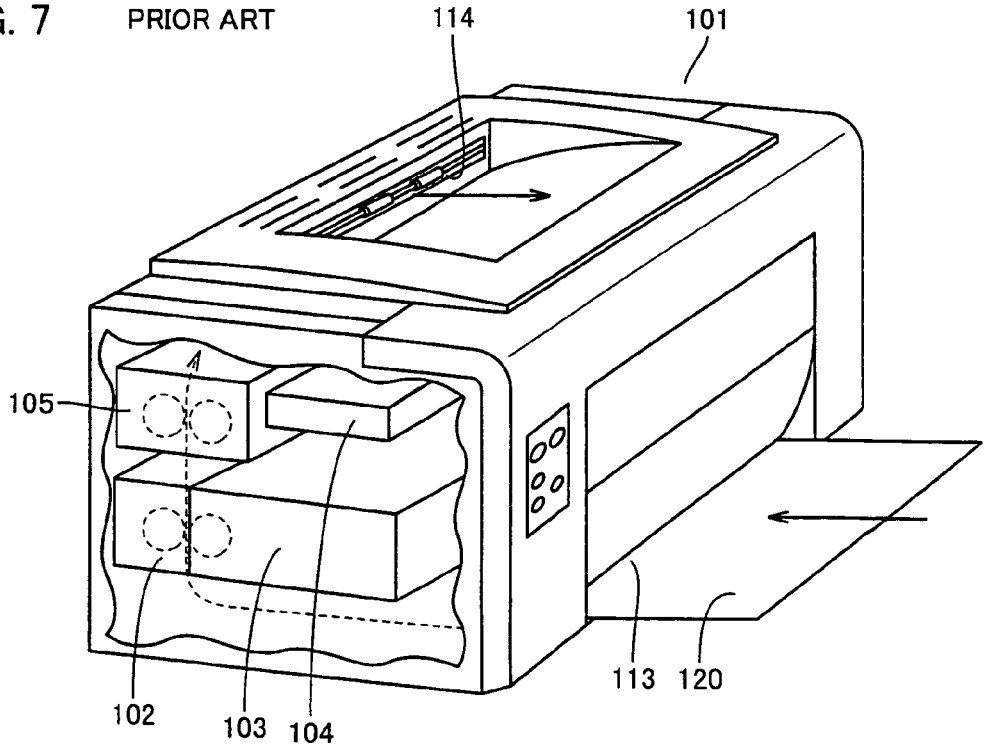
FIG. 7 PRIOR ART
FIG. 7 is an exploded perspective view of a conventional laser printer apparatus.

Here, by such an air flow, fixing unit 5 is cooled first. Then, the air that is going to the side of laser printer apparatus as shown in FIG. 6 is not hindered by raised portion 7 but passes through openings 7*a* to 7*e*, and is reliably guided to laser scanning unit 4. As a result, laser scanning unit 7 can effectively be cooled.

Openings 7*a* to 7*e* are formed such that opening area becomes gradually larger as the distance from fan 9 increases. Therefore, the difference in air flow passing through an opening far from the fan and the air flow passing through an opening closer to the fan becomes smaller, enabling uniform cooling of the laser scanning unit 4.

Further, wall portion 11 is provided on the back side of top cover 10, and thus, an air passage is formed between the wall portion 11 and the raised portion 7, so that the hot air does not stay in the laser printer apparatus 1 but is reliably guided to the fan 9, and exhausted to the outside of laser printer apparatus 1. Further, the wall portion 11 is arranged on top cover 10 such that the polygon motor 4*a* in the laser scanning unit 4 is positioned between the raised portion 7 and the wall portion 11, and therefore, polygon motor 4*a* that generates heat can be cooled in a focused manner.

As described above, in the laser printer apparatus 1, openings 7*a* to 7*e* are provided in raised portion 7 of base member 6, and wall portion is provided integral with top cover 10, and therefore, without necessitating any additional member such as a duct, the fixing unit 5 and the laser scanning unit 4 can reliably be cooled while the size of the apparatus can be made smaller.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A laser printer apparatus, comprising:

a pair of frames arranged opposite to each other;

a base member fixed on each of said pair of frames and extending in one direction across said pair of frames;

a laser scanning unit placed on said base member, directing a laser beam in accordance with a prescribed image signal;

a fixing unit arranged aligned to a side in a direction approximately orthogonal to one direction of said base member, fixing the toner transferred to the sheet of paper;

a fan arranged on one of said pair of frames at a position corresponding to an end along said one direction of said base member;

a top cover arranged to cover said base member, said laser scanning unit said fixing unit and said fan;

a raised portion provided on an end portion of said base member positioned on the side of said fixing unit, raised toward said top cover and extending in one direction;

a plurality of opening portions formed in said raised portion along said one direction, each having a prescribed opening area; and a prescribed wall portion formed on said top cover to the side of said base member, and together with said raised portion, serving as an air passage; wherein said openings are formed such that opening area becomes larger as distance from said fan increases; and said wall portion is arranged such that a polygon motor in said laser scanning unit is positioned between said raised portion and said wall portion.

2. A laser printer apparatus, comprising:

a prescribed base member extending in one direction;

a laser scanning unit placed on said base member and directing a laser beam in accordance with a prescribed image signal;

a fixing unit arranged aligned to a side in a direction approximately orthogonal to one direction of said base member, fixing the toner transferred to the sheet of paper;

a fan for cooling, arranged on a side of an end in one direction of said base member; and a raised portion formed by bending upward an end portion of said base member at the side next to said fixing unit; wherein:

said raised portion has an opening that communicates the side where the fixing unit is arranged with the side where the laser scanning unit is arranged, the opening includes a plurality of openings provided along one direction, and the plurality of openings have opening areas becoming larger as the distance from the fan increases.

3. A laser printer apparatus, comprising:

a prescribed base member extending in one direction;

a laser scanning unit placed on said base member and directing a laser beam in accordance with a prescribed image signal;

a fixing unit arranged aligned to a side in a direction approximately orthogonal to one direction of said base member, fixing the toner transferred to the sheet of paper;

a top cover arranged to cover said base member, said fixing unit and said laser scanning unit, wherein said top cover has a prescribed wall portion formed protruded to the side of said base member when said top cover is attached, for guiding air to a space formed with said raised portion;

a fan for cooling, arranged on a side of an end in one direction of said base member; and a raised portion formed by bending upward an end portion of said base member at the side next to said fixing unit wherein said raised portion has an opening that communicates the side where the fixing unit is arranged with the side where the laser scanning unit is arranged.

4. The laser printer apparatus according to claim 3, wherein said wall portion is arranged such that a polygon motor in said laser scanning unit is positioned between said raised portion and said wall portion.

5. A laser printer apparatus, comprising:

a prescribed base member extending in one direction;

a laser scanning unit placed on said base member and directing a laser beam in accordance with a prescribed image signal;

a fixing unit arranged aligned to a side in a direction approximately orthogonal to one direction of said base member, fixing the toner transferred to the sheet of paper;

a fan for cooling, arranged on a side of an end in one direction of said base member; and a raised portion formed by bending upward an end portion of said base member at the side next to said fixing unit; wherein:

said raised portion has an opening that communicates the side where the fixing unit is arranged with the side where the laser scanning unit is arranged, and said fan is arranged positioned between said raised portion and said wall portion.

* * * * *